US005962395A

United States Patent [19]

Puvvada et al.

[11] Patent Number: 5,962,395

[45] Date of Patent: Oct. 5, 1999

[54] METHOD OF ENHANCING LOW TEMPERATURE STABILITY OF LIQUID CLEANSING COMPOSITIONS

[75] Inventors: Sudhakar Puvvada, Rutherford; Richard Kolodziej, Cliffside Park; May Shana'a, Fort Lee, all of N.J.

[73] Assignee: Lever Brothers Company, New York, N.Y.

[21] Appl. No.: 08/931,156

[22] Filed: Sep. 16, 1997

Related U.S. Application Data

[60] Provisional application No. 60/026,650, Sep. 24, 1996.

[51] Int. Cl.[6] ..... C11D 1/88; C11D 1/94; C11D 1/12

[52] U.S. Cl. ..... 510/418; 510/119; 510/123; 510/125; 510/130; 510/352; 510/424; 510/490; 510/153; 510/422; 510/425

[58] Field of Search ..... 510/119, 123, 510/125, 130, 352, 424, 490, 153, 418, 422, 425

[56] References Cited

U.S. PATENT DOCUMENTS

| | | | |
|---|---|---|---|
| 4,769,169 | 9/1988 | Fishlock-Lomax | 252/106 |
| 5,015,471 | 5/1991 | Birtwistle et al. | 424/70 |
| 5,192,462 | 3/1993 | Gloor et al. | 252/174.21 |
| 5,385,206 | 1/1995 | Thomas | 166/269 |
| 5,409,640 | 4/1995 | Giret et al. | 252/546 |
| 5,478,490 | 12/1995 | Russo et al. | 252/153 |
| 5,490,955 | 2/1996 | Hagan et al. | 252/554 |
| 5,540,853 | 7/1996 | Trinh et al. | 510/101 |
| 5,607,678 | 3/1997 | Moore et al. | 424/401 |
| 5,624,666 | 4/1997 | Coffindaffer et al. | 424/70.21 |
| 5,650,384 | 7/1997 | Gordon et al. | 510/159 |
| 5,653,970 | 8/1997 | Vermeer | 424/70.24 |
| 5,696,069 | 12/1997 | Ito et al. | 510/123 |
| 5,716,920 | 2/1998 | Glenn, Jr. et al. | 510/159 |
| 5,747,435 | 5/1998 | Patel | 510/119 |
| 5,747,436 | 5/1998 | Patel et al. | 510/124 |
| 5,756,439 | 5/1998 | He et al. | 510/159 |
| 5,776,871 | 7/1998 | Cothran et al. | 510/122 |
| 5,776,872 | 7/1998 | Giret et al. | 510/124 |

FOREIGN PATENT DOCUMENTS

94/18292 8/1994 WIPO .

*Primary Examiner*—Yogendra Gupta
*Assistant Examiner*—Charles Boyer
*Attorney, Agent, or Firm*—Ronald A. Koatz

[57] ABSTRACT

The present invention relates to a method of enhancing low temperature stability of lamellar structured liquid cleansing compositions comprising 5% to 50% of a surfactant system comprising (a) anionic or mixture of anionics and (b) an amphoteric and/or zwifterionic surfactant, wherein said method comprises selecting component (b) such that alkalimetal alkylamphoacetate comprises greater than 25% to 90% of said component (b).

7 Claims, No Drawings

METHOD OF ENHANCING LOW TEMPERATURE STABILITY OF LIQUID CLEANSING COMPOSITIONS

This Application claims benefit of Provisional Application 60/026,650 filed Sep. 24, 1996.

FIELD OF THE INVENTION

The present invention relates to lamellar structured liquid cleansing compositions such as those described, for example, in applicants co-pending U.S. Ser. No. 08/512,010 filed Aug. 7, 1995. These compositions are generally used in skin cleansing or shower gel compositions. In particular, the invention relates to a method of enhancing low temperature (e.g., 20° F. and below down to 0° F.) stability in such compositions by careful selection of the surfactant system.

BACKGROUND OF THE INVENTION

Typically, lamellar structured liquid cleansing compositions (e.g., shower gel compositions) comprise a mixture of anionic surfactants (for cleansing and foaming attributes) and mild surfactant. In a typical shower formulation, the mild surfactant may be an amphoteric and/or zwifterionic surfactant such as those described in U.S. Ser. No. 08/512,010 mentioned above, hereby incorporated by reference into the subject application.

In such lamellar structured compositions, however, it has been found that there is considerable thinning of product as the product is cooled down to temperatures of 20° to 0° F. This loss of viscosity is not a desirable property.

Unexpectedly, applicants have found that when alkalimetal alkyl amphoacetate is used as greater than 25% to 90%, preferably 30% to 90% and more preferably about 40% to 90% of the amphoteric and/or zwitterionic component in the surfactant system, there is a significant increase in product stability.

U.S. Ser. No. 08/512,010 shows one example (Example IX at page 23) where sodium cocoamphoacetate is used. However, in neither that example or in the other eight examples are there ever taught blends of other amphoteric (e.g., betaine) and amphoacetate. Nor is there any teaching or suggestion in that application that blends of amphoteric will ameliorate low temperature instability in such compositions. Indeed, until the problem of low temperature instability was even appreciated, it could not have been known that selecting the specific surfactant system of the invention could ameliorate the problem.

BRIEF DESCRIPTION OF THE INVENTION

The present invention relates to lamellar structured liquid cleansing compositions comprising about 5% to 50% of a surfactant system wherein said surfactant system comprises (a) an anionic or mixture of anionics and (b) a blend of amphoteric and/or zwitterionic surfactants wherein said blend comprises alkalimetal alkylamphoacetate and said alkalimetal alkylamphoacetate comprises grater than 25% to about 90%, preferably 30% to 75% and more preferably 40% to 60% of the blend.

Unexpectedly, applicants have found that when amphoteric/zwitterionic component is selected in lamellar structured compositions comprising anionic (or mixture) and amphoteric/zwitterionic such that alkali metal alkylamphoacetate comprises a minimum amount of the amphoteric/zwitterionic blend, this significantly enhances cold temperature stability of the lamellar structured composition relative to compositions where the alkalimetal alkylamphoacetate does not comprise a portion or comprises less than 25% of the amphoteric/zwitterionic blend.

DETAILED DESCRIPTION OF THE INVENTION

The present invention relates to a method of enhancing stability of low temperature compositions (i.e., temperatures of from about 20° F. to about 0° F.) lamellar structured liquid cleansing compositions comprising about 5% to about 50% of a surfactant system which surfactant system in turn comprises:

(a) anionic or mixture of anionic surfactant; and (b) an amphoteric and/or zwitterionic surfactant or mixture thereof, wherein said method comprises selecting component (b) such that the alkalimetal alkyl amphoacetate comprises greater than 25% to 90%, preferably about 30% to 90%, more preferably about 40% to 90% of said component (b).

The anionic surfactant may be, for example, an aliphatic sulfonate, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or an aromatic sulfonate such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably between 2 and 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, and acyl isethionates.

Sulfosuccinates may be monoalkyl sulfosuccinates having the formula:

$$R^4O_2CCH_2CH(SO_3M)CO_2M;$$

amido-MEA sulfosuccinates of the formula $$R^4CONHCH_2CH_2O_2CCH_2CH(SO_3M)CO_2M$$

wherein $R^4$ ranges from $C_8$–$C_{22}$ alkyl and M is a solubilizing cation;

amido-MIPA sulfosuccinates of formula $$RCONH(CH_2)CH(CH_3)(SO_3M)CO_2M$$

where M is as defined above.

Also included are the alkoxylated citrate sulfosuccinates; and alkoxylated sulfosuccinates such as the following:

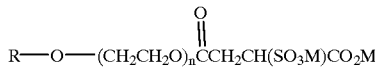

wherein n=1 to 20; and M is as defined above.

Sarcosinates are generally indicated by the formula $RCON(CH_3)CH_2CO_2M$, wherein R ranges from $C_8$ to $C_{20}$ alkyl and M is a solubilizing cation.

Taurates are generally identified by formula $$R^2CONR^3CH_2CH_2SO_3M$$

wherein $R^2$ ranges from $C_8$–$C_{20}$ alkyl, R ranges from $C_1$–$C_4$ alkyl and M is a solubilizing cation.

Another class of anionics are carboxylates such as follows:

$$R\text{-}(CH_2CH_2O)_nCO_2M$$

wherein R is C8 to $C_{20}$ alkyl; n is 0 to 20; and M is as defined above.

Another carboxylate which can be used is amido alkyl polypeptide carboxylates such as, for example, Monteine LCQ(R) by Seppic.

Another surfactant which may be used are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 0.5–15% by weight of the total composition. Preferably, this component is present from about 1 to about 10%.

The acyl isethionate may be an alkoxylated isethionate such as is described in llardi et al., U.S. Pat. No. 5,393,466, hereby incorporated by reference into the subject application. This compound has the general formula:

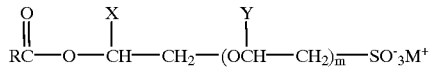

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 1 to 20% by weight of the composition, preferably 2 to 15%, most preferably 5 to 12% by weight of the composition.

Zwitterionic and Amphoteric Surfactants Zwitterionic surfactants are exemplified by those which can be broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. A general formula for these compounds is:

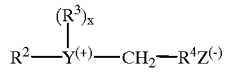

wherein $R^2$ contains an alkyl, alkenyl, or hydroxy alkyl radical of from about 8 to about 18 carbon atoms, from 0 to about 10 ethylene oxide moieties and from 0 to about 1 glyceryl moiety; Y is selected from the group consisting of nitrogen, phosphorus, and sulfur atoms; $R^3$ is an alkyl or monohydroxyalkyl group containing about 1 to about 3 carbon atoms; X is 1 when Y is a sulfur atom, and 2 when Y is a nitrogen or phosphorus atom; $R^4$ is an alkylene or hydroxyalkylene of from about 1 to about 4 carbon atoms and Z is a radical selected from the group consisting of carboxylate, sulfonate, sulfate, phosphonate, and phosphate groups.

Examples of such surfactants include:

4-[N,N-di(2-hydroxyethyl)-N-octadecylammonio]-butane-1-carboxylate;

5-[S-3-hydroxypropyl-S-hexadecylsulfonio]-3-hydroxypentane-1-sulfate;

3-[P,P-d iethyl-P-3 ,6, 9-trioxatetradexocylphosphonio]-2-hydroxypropane-1-phosphate;

3-[N,N-dipropyl-N-3-dodecoxy-2-hydroxypropylammonio]-propane-1-phosphonate;

3-(N,N-dimethyl-N-hexadecylammonio)propane-1-sulfonate;

3-(N,N-dimethyl-N-hexadecylammonio)-2-hydroxypropane-1-sulfonate;

4-[N,N-di(2-hydroxyethyl)-N-(2-hydroxydodecyl) ammonio]-butane-1-carboxylate;

3-[S-ethyl-S-(3-dodecoxy-2-hydroxypropyl)sulfonio]-propane-1-phosphate;

3-[P,P-dimethyl-P-dodecylphosphonio]-propane-1-phosphonate; and

5-[N,N-di(3-hydroxypropyl)-N-hexadecylammonio]-2-hydroxy-pentane-1-sulfate.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

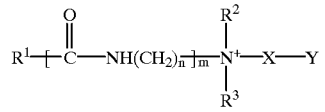

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

n is 2 to 4;

m is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

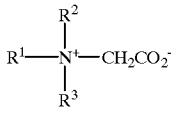

and amido betaines of formula:

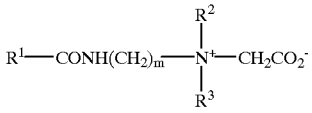

where m is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula

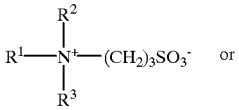

or

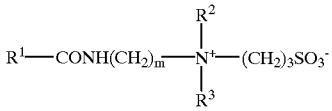

where m is 2 or 3, or variants of these in which $—(CH_2)_3SO^-_3$ is replaced by

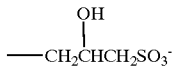

In these formulae $R^1$, $R^2$ and $R^3$ are as discussed previously.

The amphoteric/zwitterionic generally comprises 0.1 to 20% by weight, preferably 5% to 15% of the composition.

A critical aspect of this invention is that the zwitterionic/amphoteric compounds must be used in blends of zwitterionic/amphoteric wherein one component of the blend is an alkalimetal alkylamphoacetate. Further, the alkali metal alkylamphoacetate must comprise greater than 25% to 90%, preferably about 30% to 90%, more preferably about 40% to 90% of the blend.

Examples of alkalimetal alkyl amphoacetate compounds include, but are not limited to, sodium or potassium lauro or cocoamphoacetate The total amount of amphoteric/zwitterionic including the amphoacetate, preferably should be no greater than 20%, more preferably no greater than 15%. The total amphotericlzwitterionic should comprise at least 5% of the composition.

In addition to one or more anionic and amphoteric and/or zwitterionic, the surfactant system may optionally comprise a nonionic surfactant.

The nonionic which may be used includes in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic (C8–C18) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Other surfactants which may be used are described in U.S. Pat. No. 3,723,325 to Parran Jr. and alkyl polysaccharide nonionic surfactants as disclosed in U.S. Pat. No. 4,565,647 to Llenado, both of which are also incorporated into the subject application by reference.

Preferred alkyl polysaccharides are alkylpolyglycosides of the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which alkyl groups contain from about 10 to about 18, preferably from about 12 to about 14, carbon atoms; n is 0 to 3, preferably 2; t is from 0 to about 10, preferably 0; and x is from 1.3 to about 10, preferably from 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Nonionic comprises 0 to 10% by wt. of the composition.

In general, the compositions of the invention are soap-free compositions.

Structurant

The present invention provides compositions utilizing about 0.1% to 15% by wt., preferably 1 to 10% by wt. of a structuring agent which works in the compositions to form a lamellar phase. Such lamellar phase is preferred because it enables the compositions to suspend particles more readily (e.g., emollient particles) while still maintaining good shear thinning properties. The lamellar phase also provides consumers with desired rheology ("heaping").

More particularly, where the composition is not lamellar structured and enhanced particle suspension/enhancing is desired, it is usually necessary to add external structurants such as carbomers (e.g., cross-linked polyacrylate such as Carbopol®) and clays. However, these external structurants have poorer shear thinning properties that significantly reduce consumer acceptability.

The structurant is generally an unsaturated and/or branched long chain ($C_8$–$C_{24}$) liquid fatty acid or ester derivative thereof; and/or unsaturated and/or branched long chain liquid alcohol or ether derivatives thereof. It may also be a short chain saturated fatty acid such as capric acid or caprylic acid. While not wishing to be bound by theory, it is believed that the unsaturated part of the fatty acid of alcohol or the branched part of the fatty acid or alcohol acts to "disorder" the surfactant hydrophobic chains and induce formation of lamellar phase.

Examples of liquid fatty acids which may be used are oleic acid, isostearic acid, linoleic acid, linolenic acid, ricinoleic acid, elaidic acid, arichidonic acid, myristoleic acid and palmitoleic acid. Ester derivatives include propylene glycol isostearate, propylene glycol oleate, glyceryl isostearate, glyceryl oleate and polyglyceryl diisostearate.

Examples of alcohols include oleyl alcohol and isostearyl alcohol. Examples of ether derivatives include isosteareth or oleth carboxylic acid; or isosteareth or oleth alcohol.

The structuring agent may be defined as having melting point below about 25° C. centigrade.

Oil/Emollient

One of the principle benefits of the invention is the ability to suspend oil/emollient particles in a lamellar phase composition.

Various classes of oils are set forth below.

Vegetable oils: Arachis oil, castor oil, cocoa butter, coconut oil, corn oil, cotton seed oil, olive oil, palm kernel oil, rapeseed oil, safflower seed oil, sesame seed oil and soybean oil.

Esters: Butyl myristate, cetyl palmitate, decyloleate, glyceryl laurate, glyceryl ricinoleate, glyceryl stearate, glyceryl isostearate, hexyl laurate, isobutyl palmitate, isocetyl stearate, isopropyl isostearate, isopropyl laurate, isopropyl linoleate, isopropyl myristate, isopropyl palmitate, isopropyl stearate, propylene glycol monolaurate, propylene glycol ricinoleate, propylene glycol stearate, and propylene glycol isostearate.

Animal Fats: Acetylated lanolin alcohols, lanolin, lard, mink oil and tallow.

Fatty acids and alcohols: Behenic acid, palmitic acid, stearic acid, behenyl alcohol, cetyl alcohol, eicosanyl alcohol and isocetyl alcohol.

Other examples of oil/emollients include mineral oil, petrolatum, silicone oil such as dimethyl polysiloxane, lauryl and myristyl lactate.

It should be understood that where the emollient may also function as a structurant, it should not be doubly included such that, for example, if the structurant is 15% oleyl alcohol, no more than 5% oleyl alcohol as "emollient" would be added since the emollient (whether functioning as emollient or structurant) never comprises more than 20%, preferably no more than 15% of the composition.

The emollient/oil is generally used in an amount from about 1 to 20%, preferably 1 to 15% by wt. of the composition. Generally, it should comprise no more than 20% of the composition.

In addition, the compositions of the invention may include optional ingredients as follows:

Organic solvents, such as ethanol; auxiliary thickeners, such as carboxymethylcellulose, magnesium aluminum silicate, hydroxyethylcellulose, methylcellulose, carbopols, glucamides, or Antil® from Rhone Poulenc; perfumes; sequestering agents, such as tetrasodium ethylenediaminetetraacetate (EDTA), EHDP or mixtures in an amount of 0.01 to 1%, preferably 0.01 to 0.05%; and coloring agents, opacifiers and pearlizers such as zinc stearate, magnesium stearate, $TiO_2$, EGMS (ethylene glycol monostearate) or Lytron 621 (Styrene/Acrylate copolymer); all of which are useful in enhancing the appearance or cosmetic properties of the product.

The compositions may further comprise antimicrobials such as 2-hydroxy4,2'4' trichlorodiphenylether (DP300); preservatives such as dimethyloldimethylhydantoin (Glydant XL1000), parabens, sorbic acid etc.

The compositions may also comprise coconut acyl mono- or diethanol amides as suds boosters, and strongly ionizing salts such as sodium chloride and sodium sulfate may also be used to advantage.

Antioxidants such as, for example, butylated hydroxytoluene (BHT) may be used advantageously in amounts of about 0.01% or higher if appropriate.

Cationic conditioners which may be used include Quatrisoft LM-200 Polyquaternium-24, Merquat Plus 3330—Polyquaternium 39; and Jaguar® type conditioners.

Polyethylene glycols which may be used include:

| | | |
|---|---|---|
| Polyox | WSR-205 | PEG 14M, |
| Polyox | WSR-N-60K | PEG 45M, or |
| Polyox | WSR-N-750 | PEG 7M. |

Thickeners which may be used include Amerchol Polymer HM 1500 (Nonoxynyl Hydroethyl Cellulose); Glucam DOE 120 (PEG 120 Methyl Glucose Dioleate); Rewoderm® (PEG modified glyceryl cocoate, palmate or tallowate) from Rewo Chemicals; Antil® 141 (from Goldschmidt). A particularly preferred thickener is xanthan gum. Indeed, xanthan gum, particularly when used with the surfactant system of the invention, also help ameliorate cold storage instability.

Another optional ingredient which may be added are the defloculating polymers such as are taught in U.S. Pat. No. 5,147,576 to Montague, hereby incorporated by reference.

Another ingredient which may be included are exfoliants such as polyoxyethylene beads, walnut sheets and apricot seeds In a second embodiment, the invention comprises a method of enhancing low temperature stability of a lamellar structurant liquid cleansing composition comprising about 5% to 50% of a surfactant system as described above, wherein said method comprises selecting amphoteric and/or zwitterionic component (b) such that alkalimetal alkylamphoacetate comprises greater than 25% to 90%, preferably 30% to 75%, more preferably 40% to 60% of component (b).

The invention will be described in greater detail by way of the following non-limiting examples. The examples are for illustrative purposes only and not intended to limit invention in any way.

All percentages in specification and example are intended to be by weight unless states otherwise.

EXAMPLES

The following compositions are used in the examples:

| Ingredients | I | II | III | IV |
|---|---|---|---|---|
| Cocoamido Propyl Betaine | 12 | 9 | 6 | 0 |
| Sodium Lauroamphoacetate | 0 | 3 | 6 | 12 |
| Sodium Cocoyl Isethionate | 6.5 | 6.5 | 6.5 | 6.5 |
| Sodium Laureth Sulfate | 6.5 | 6.5 | 6.5 | 6.5 |
| Thickener/Polymer (e.g., Cationic, Guar or Xanthan Gum) | 0.1 to 1% | 0.1 to 1% | 0.1 to 1% | 0.1 to 1% |
| Emollient | 1 to 7% | 1 to7% | 1 to 7% | 1 to 7% |
| Structurant | 3 to 10% | 3 to 10% | 3 to 10% | 3 to 10% |
| Titanium Dioxide | 0.2 | 0.2 | 0.2 | 0.2 |
| DMDM Hydantoin | 0.2 | 0.2 | 0.2 | 0.2 |
| Fragrance | 1.0 | 1.0 | 1.0 | 1.0 |

-continued

| Ingredients | I | II | III | IV |
|---|---|---|---|---|
| BHT | 0.0075 | 0.0075 | 0.0075 | 0.007 |
| Water | to 100.0 | to 100.0 | to 100.0 | to 100.0 |

Examples 1–4

The compositions shown above in I–IV were stored in plastic cups at 15° F. and 0° F. period of 1 day and then equilibrated back to room temperature. Care was Taken not to to disturb the sample since viscosity increase when these products are The viscosity of the sample is then measured using a Brookfield RV ter attached to a helipath accessory and using T-Bar Spindle A.

The results are set forth in Table 1 below:

| | | T-Bar Viscosity | | |
|---|---|---|---|---|
| Example | % Amphoacetate in Betaine/ Amphoacetate Blend | Room Tempera-ture | After 1 Day at 15° F. | After 1 Day at 0° F. |
| 1 | 0 | 88400 | 22800 | 22400 |
| 2 | 25 | 91200 | 26000 | 33200 |
| 3 | 50 | 97200 | 84000 | 93200 |

As seen from the Table, (Examples 2 and 3), when etate comprises about 25% and greater, preferably about 30% to 90% and preferably about 40% to 90% of blend of amphoteric (betaine/amphoacetate viscosity at low temperature (15° F., 0° F.) remains much higher. Thus, clearly, temperature viscosity/phase stability is much superior relative to compositions in amphoacetate is not used or comprises less than 25% of the blend (e.g., Example 1).

We claim:

1. A method of enhancing low temperature stability of a lamellar structured liquid cleansing compositions comprising:

(1) 5% to 50% by wt. of a surfactant system which surfactant system comprises:

(a) anionic or mixture of anionic surfactants; and (b) an amphoteric and/or zwitterionic surfactant or mixture thereof; and (2) 0.1 to 15% by wt. of a structurant selected from the group consisting of:

(a) unsaturated, unbranched $C_8$ to $C_{24}$ liquid fatty acid or ester thereof;

(b) saturated, branched $C_8$ to $C_{24}$ liquid fatty acid or ester thereof;

(c) unsaturated, unbranched $C_8$ to $C_{24}$ liquid alcohol or ether thereof;

(d) saturated, branched $C_8$ to $C_{24}$, liquid alcohol or ether thereof;

(e) short chain saturated fatty acid selected from the group consisting of capric acid, caprylic acid and mixtures thereof; and (f) mixtures thereof;

wherein said method comprises selecting the amphoteric and/or zwitterionic surfactant component (1) (b) such that alkalimetal alkyl amphoacetate comprises greater than 25% to 90% of said component (b).

2. A method according to claim 1, wherein alkalimetal alkylamphoacetate comprises greater than 30% to 90% of component (b).

3. A method according to claim 2, wherein alkalimetal alkylamphoacetate comprises about 40% to 90% of component (b).

4. A method according to claim 1, wherein anionic is selected from the group consisting of alkyl sulfates, acyl isethionates and mixtures thereof.

5. A method according to claim 1, wherein composition comprises 0 to 25% betaine.

6. A method according to claim 5, wherein composition comprises 0.1 to 20% betaine.

7. A method according to claim 1, wherein composition additionally comprises 0% to 10% nonionic.

* * * * *